United States Patent [19]

McCue, Jr.

[11] Patent Number: 5,035,732

[45] Date of Patent: Jul. 30, 1991

[54] CRYOGENIC SEPARATION OF GASEOUS MIXTURES

[75] Inventor: Richard H. McCue, Jr., Houston, Tex.

[73] Assignee: Stone & Webster Engineering Corporation, Boston, Mass.

[21] Appl. No.: 462,395

[22] Filed: Jan. 4, 1990

[51] Int. Cl.[5] ..... F25J 3/02

[52] U.S. Cl. ..... 62/24; 62/28; 62/36; 62/44

[58] Field of Search ..... 62/11, 23, 24, 27, 28, 62/31, 32, 36, 42, 44

[56] References Cited

U.S. PATENT DOCUMENTS

| | | | |
|---|---|---|---|
| 2,214,790 | 9/1940 | Greenewalt | 62/175.5 |
| 2,582,068 | 1/1952 | Roberts | 62/123 |
| 3,186,182 | 5/1963 | Grossman et al. | 62/26 |
| 3,444,696 | 2/1967 | Geddes et al. | 62/28 |
| 3,555,836 | 1/1971 | Schramm | 62/9 |
| 3,635,038 | 1/1972 | Nagel et al. | 62/17 |
| 3,675,435 | 7/1972 | Jackson et al. | 62/26 |
| 4,002,042 | 1/1977 | Pryor et al. | 62/28 |
| 4,167,402 | 9/1979 | Davis | 62/28 |
| 4,203,742 | 5/1980 | Agnihotri | 62/24 |
| 4,270,939 | 6/1981 | Rowles et al. | 62/22 |
| 4,270,940 | 6/1981 | Rowles et al. | 62/28 |
| 4,336,045 | 6/1982 | Fisher et al. | 62/17 |
| 4,368,061 | 1/1983 | Mestrallet et al. | 62/24 |
| 4,519,825 | 5/1985 | Bernhard | 62/28 |
| 4,525,187 | 6/1985 | Woodward et al. | 62/31 |
| 4,548,629 | 10/1985 | Chiu | 62/24 |
| 4,608,068 | 8/1988 | Bauer et al. | 62/18 |
| 4,622,053 | 11/1986 | Tomlinson et al. | 62/26 |
| 4,657,571 | 4/1987 | Gazzi | 62/17 |
| 4,707,170 | 11/1987 | Ayres et al. | 62/24 |
| 4,714,487 | 12/1987 | Rowles | 62/24 |
| 4,720,293 | 1/1988 | Rowles et al. | 62/24 |
| 4,726,826 | 2/1988 | Crawford et al. | 62/20 |
| 4,732,598 | 3/1988 | Rowles et al. | 62/28 |
| 4,749,393 | 6/1988 | Rowles et al. | 62/24 |
| 4,759,786 | 7/1988 | Atkinson et al. | 62/24 |

FOREIGN PATENT DOCUMENTS 61105523 10/1984 Japan .

OTHER PUBLICATIONS

Huang, "Cut Demethanizer Energy Costs", Hydrocarbon Processing, Oct. 1980, pp. 105–108.

Kaiser et al., "Analyze Mixed Refrigerant Cycles", *Hydrocarbon Processing,* Jul. 1978, pp. 163–167.

Albers et al., "Olefins Plant Optimization Keyed to Demethanization", *The Oil and Gas Journal,* Sep. 4, 1978, pp. 72–78.

Hurstel et al., "Refrigeration Schemes Serve Olefin Plant Needs", *Oil and Gas Journal,* Sep. 7, 1981, pp. 107–123.

Kaiser et al., "Optimize Demethanizer Pressure for Maximum Ethylene Recovery", *Hydrocarbon Processing,* Jun. 1979, 115–121.

*Primary Examiner*—Ronald C. Capossela

*Attorney, Agent, or Firm*—Hedman, Gibson, Costigan & Hoare

[57] ABSTRACT

A cryogenic technique for recovering ethene from a gaseous mixture containing methane, ethane, etc. Operating methods and apparatus are provided for passing the gas feed through a chilling train having a series of dephlegmator-type exchange units to condense liquid rich in ethene and ethane, while separating a major portion of methane and lighter gas. A multizone demethanizer removes condensed methane from the $C_2$ fraction to provide multiple methane free liquid streams of varying ethene to ethane ratio at least one of which is essentially $C_3$ free.

44 Claims, 3 Drawing Sheets

CRYOGENIC SEPARATION OF GASEOUS MIXTURES

CROSS REFERENCE TO RELATED APPLICATION

This application is related to U.S. Pat. Application, Ser. No. 07/333,214, filed Apr. 5, 1989, for Cryogenic Separation of Gaseous Mixtures now U.S. Pat. No. 4,900,347.

BACKGROUND OF THE INVENTION

The present invention relates to improvements in the cold fractionation of light gases. In particular it relates to a new and improved method for recovering ethene (ethylene) from cracking gas or the like in mixture with methane, ethane and other components requiring low temperature refrigeration. More particularly, it relates to the use of serially connected low temperature fractionating sections or dephlegmators and plural demethanizers to effect the separation.

Cryogenic technology has been employed on a large scale for recovering gaseous hydrocarbon components, such as $C_1$–$C_2$ alkanes and alkenes from diverse sources, including natural gas, petroleum refining, coal and other fossil fuels. Separation of high purity ethene from other gaseous components of cracked hydrocarbon effluent streams has become a major source of chemical feedstocks for the plastics industry. Polymer grade ethene, usually containing less than 1 percent of other materials, can be obtained from numerous industrial process streams. Thermal cracking and hydrocracking of hydrocarbons are employed widely in the refining of petroleum and utilization of $C_2$+condensible wet gas from natural gas or the like. Low cost hydrocarbons are typically cracked at high temperature to yield a slate of valuable products, such as pyrolysis gasoline, lower olefins and LPG, along with byproduct methane and hydrogen. Conventional separation techniques performed at or near ambient temperature and pressure can recover many cracked effluent components by sequential liquefaction, distillation, sorption, etc. However, separating methane and hydrogen from the more valuable $C_2$+aliphatics, especially ethene and ethane, requires relatively expensive equipment and processing energy.

Plural stage rectification and cryogenic chilling trains have been disclosed in many publications, especially Perry's Chemical Engineering Handbook (5th Ed.), and other treatises on distillation techniques. Recent commercial applications have employed dephlegmatortype rectification units in chilling trains and as reflux condenser means in demethanization of gas mixtures. Typical rectification units are described in U.S. Pat. Nos. 2,582,068 (Roberts); 4,002,042, 4,270,940, 4,519,826, 4,732,598 (Rowles et al.); and 4,657,571 (Gazzi), incorporated herein by reference. Typical prior art demethanizer units have required a very large supply of ultra low temperature refrigerant and special materials of construction to provide adequate separation of $C_1$–$C_2$ binary mixtures or more complex compositions. As reported by Kaiser et al. in *Hydrocarbon Processing*, Nov. 1988, pp 57–61, a better ethylene separation unit with improved efficiency can utilize plural demethanizer towers. Ethene recovery of at least 99 percent is desired, requiring essentially total condensation of the $C_2$+fraction in the chilling train to feed the distillation towers. It is known that the heavier $C_3$+components, such as propylene, can be removed in a front end deethanizer; however, this expedient can be less efficient than the preferred separation technique employed herein.

SUMMARY OF THE INVENTION

It is an object of the present invention to provide an improved cold fractionation system for separating light gases at low temperature which is energy efficient and saves capital investment in cryogenic equipment.

It is another object of the present invention to produce purified ethene from a cracked hydrocarbon gaseous effluent.

It is still another object of the present invention to provide an improved process for separating and recovering $C_2$ hydrocarbons from a feed gas comprising methane, ethane and ethene, and possibly other components such as hydrogen and minor amounts of $C_3$+components.

It is another object of the present invention to provide an efficient cold fractionation system comprised of a plurality of serially arranged fractionating sections or dephlegmators in combination with serially connected demethanizers wherein the second of two demethanizers is operated at low pressure conditions.

To this end, a new improved cryogenic technique has been found for separating and recovering $C_2$+hydrocarbons from a feed gas comprising methane, ethene and ethane, which may also include hydrogen and minor amounts of $C_3$+components, wherein cold pressurized gaseous streams are separated in a plurality of rectification chilling zones, preferably dephlegmator units. In one design configuration, each of the dephlegmator units is operatively connected to accumulate condensed $C_2$-rich liquid in the lower dephlegmator drum vessels by gravity flow from the upper dephlegmator heat exchangers. This invention provides methods and means for: introducing dry feed gas into a primary dephlegmation zone having a plurality of serially connected, sequentially colder dephlegmator units for separation of feed gas into a primary methane rich gas stream recovered at low temperature and at least one primary liquid condensate stream rich in $C_2$+hydrocarbon components and containing a minor amount of methane; passing at least one primary liquid condensate stream from the primary dephlegmation zone to serially connected demethanizer fractionators, wherein a moderately low cryogenic temperature is employed in a first demethanizer fractionator unit to remove a major amount of methane from the primary liquid condensate stream in the first demethanizer overhead vapor stream and to recover a first $C_2$+liquid demethanizer bottoms stream substantially free of methane; and further separating at least a portion of the first demethanizer overhead vapor stream in an ultra-low temperature final demethanizer fractionator unit to recover ethene-rich $C_2$ hydrocarbon liquid product and a final demethanizer ultra-low temperature overhead vapor stream, whereby energy requirements for refrigeration utilized in separating the $C_2$+hydrocarbons from methane and lighter components are low.

A methane-rich stream may be obtained by passing the final demethanizer overhead vapor stream to a final dephlegmator or fractionation unit to obtain a final liquid reflux stream for recycle to a top portion of the final demethanizer fractionator and a final dephlegmator overhead vapor stream substantially free of $C_2$+hydrocarbons.

The improved cryogenic separation apparatus of the present invention has been designed for recovering a higher-boiling first gaseous component from a lower-boiling second gaseous component in a feedstock mixture thereof comprising: a source of primary coolant, moderately low temperature refrigerant and ultra low temperature coolant; a sequential chilling train means including a primary dephlegmator or fractionating unit operatively connected in serial flow relationship with at least one additional dephlegmator or fractionating unit, wherein a cold pressurized gaseous stream is separated in the series of dephlegmator or fractionating units, each of said dephlegmator or fractionating units having means for accumulating condensed liquid rich in higher-boiling components in a lower dephlegmator drum from an upper dephlegmator heat exchanger wherein gas flowing upwardly is partially condensed to form a reflux liquid in direct contact with the upwardly flowing gas to provide a condensed stream of cooler liquid flowing downwardly and thereby enriching the condensed dephlegmator liquid gradually with higher-boiling components; means for feeding dry pressurized feedstock to the primary dephlegmator unit for sequential chilling to separate the feedstock mixture into a primary gas stream rich in lower boiling components and a primary liquid condensate stream rich in higher boiling components and containing a minor amount of lower boiling components.

Fluid handling means is provided for passing the primary liquid condensate stream from the primary dephlegmator unit to the low temperature demethanizer fractionation system for recovering condensed lower-boiling components from condensed liquid. The demethanizer fractionation system has a first demethanizer fractionation zone including first reflux condenser means operatively connected to the source of moderately low temperature coolant to recover a major amount of lower-boiling components from the primary liquid condensate stream in a first demethanizer fractionator bottoms stream substantially free of lower-boiling components. The demethanizer fractionation system also has a second demethanizer fractionation zone operatively connected to the source of ultra low temperature coolant to recover a liquid product stream consisting essentially of higher boiling components and a second demethanizer fractionator ultra-low temperature overhead vapor stream. Advantageously, the system is provided with means for passing an intermediate liquid stream condensed from at least one subsequent dephlegmator unit to a middle stage of the second demethanizer fractionation zone and a final dephlegmator unit connected to receive the second demethanizer fractionator overhead vapor stream, including ultra low temperature heat exchange means for obtaining a final liquid reflux stream for recycle to an upper stage of the second demethanizer fractionation zone and a final dephlegmator overhead vapor stream substantially free of higher-boiling components.

For improved energy efficiency this system preferably includes means for contacting at least a portion of said first demethanizer fractionator overhead vapor stream in heat exchange relationship with an intermediate liquid stream, thereby reducing ultra low temperature refrigeration requirements for the second reflux condenser means. This can be effected by providing a countercurrent direct stream contact unit operatively connected between the primary and secondary demethanizer fractionator zones, with liquid from the countercurrent contact zone being directed to a lower stage of the secondary demethanizer fractionator zone and vapor from the interfractionator liquid-gas contact zone being directed to a higher stage of the secondary zone.

Further, the process is particularly efficient when the secondary demethanizer fractionator is operated at low pressure conditions, i.e. below about 160 psia. The system is provided with means to reduce the pressure in the lines delivering the various process components to the secondary demethanizer. The low pressure demethanizer performs particularly well in the system when the overhead from the final stage dephlegmator is treated to separate hydrogen from the liquids that are delivered to the top tray of the secondary demethanizer to serve as reflux. In addition, the hydrogen from the last serial dephlegmator overhead provides motive force via expanders to drive system compressors.

THE DRAWINGS

DESCRIPTION OF THE PREFERRED EMBODIMENTS

In the following description, metric units and parts by weight are used unless otherwise stated, and gaseous mixtures are sometimes given in moles or mole percent. Temperature is given in degrees Celsius (° C.), Fahrenheit (° F.) or Kelvin (° K.). In the process of separating $C_1$–$C_2$ gaseous components, references are made to the sources of progressively colder moderately low temperature coolant and ultra low temperature coolant, which temperature ranges are generally taken to mean about 235° to 290° K., and less than about 235° K., respectively. Although at least three different refrigeration loops are used in the preferred embodiments, major refineries may have four–eight loops within or overlapping these temperature ranges.

Cryogenic Separation Feedstocks

The present process is useful for separating mainly $C_1$–$C_2$ gaseous mixtures containing large amounts of ethene (ethylene), ethane and methane. Significant amounts of hydrogen usually accompany cracked hydrocarbon gas, along with minor amounts of $C_3$+hydrocarbons, nitrogen, carbon dioxide and acetylene. The acetylene component may be removed before or after cryogenic operations; however, it is advantageous to hydrogenate a de-ethanized $C_2$ stream catalytically to convert acetylene prior to a final ethene product fractionation. Typical petroleum refinery offgas or paraffin cracking effluent are usually pretreated to remove any acid gases and then dried over a water-absorbing molecular sieve to a dew point of about 145° K. to prepare the cryogenic feedstock mixture. A typical feedstock gas comprises cracking gas containing about 10 to 50 mole percent ethene, 5 to 20 percent ethane, 10 to 40 percent methane, 10 to 40 percent hydrogen, and up to 10 percent $C_3$ hydrocarbons.

In a preferred embodiment, dry compressed cracked feedstock gas at ambient temperature or below and at process pressure of at least 2500 kPa (350 psig), preferably about 3700 kPa (37.1 kgf/cm$^2$, 520 psig), is separated in a chilling train under cryogenic conditions into several liquid streams and gaseous methane/hydrogen streams. The more valuable ethene stream is recovered at high purity suitable for use in conventional polymerization.

Figure 1:
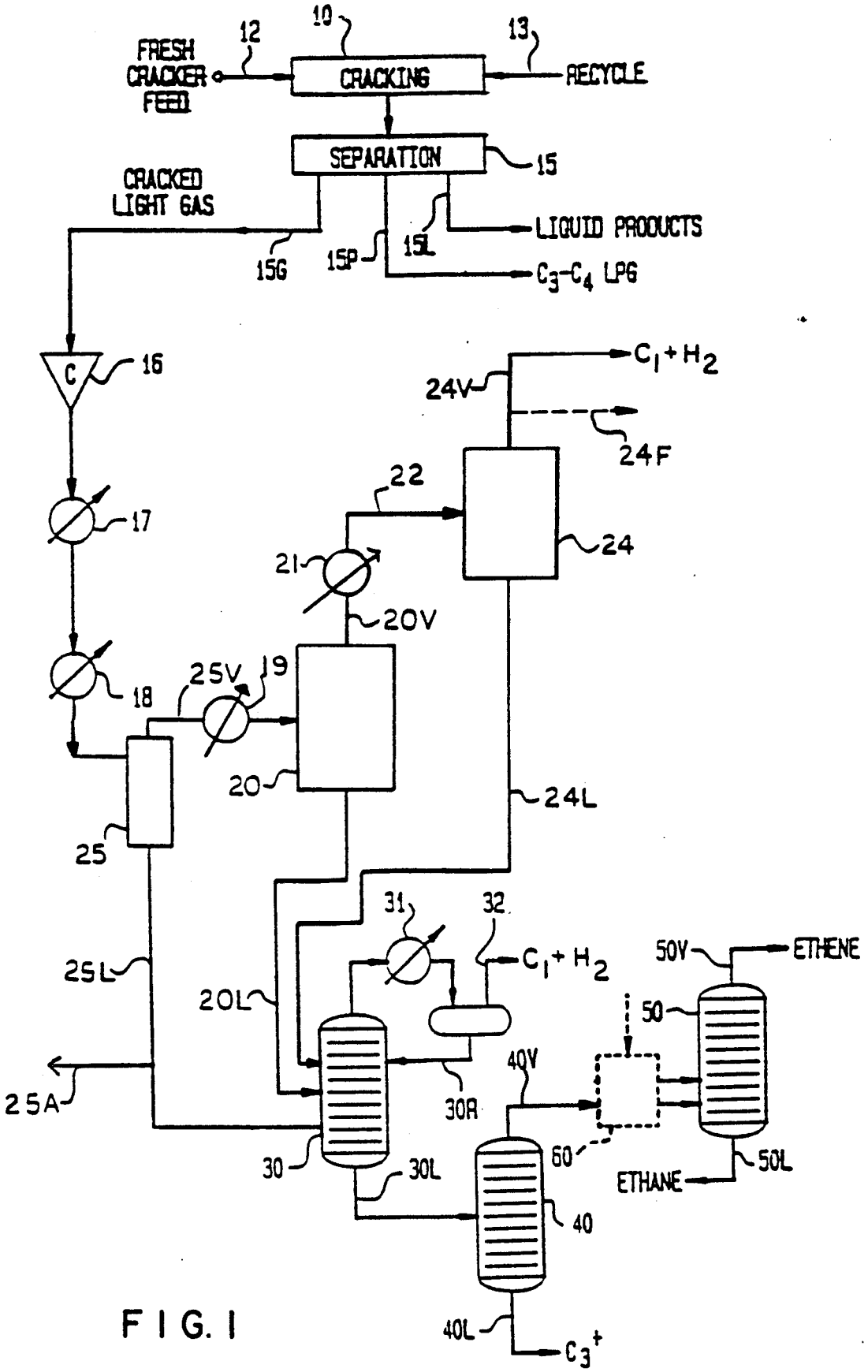
FIG. 1 is a schematic process flow diagram depicting arrangement of unit operations for a typical hydrocarbon processing plant utilizing cracking and cold fractionation for ethene production.

Referring to FIG. 1, a cryogenic separation system for recovering purified ethene from hydrocarbon feedstock gas is depicted in a schematic diagram. A conventional hydrocarbon cracking unit 10 converts fresh feed, such as ethane, propane, naphtha or heavier feeds 12 and optional recycled hydrocarbons 13 to provide a cracked hydrocarbon effluent stream. The cracking unit effluent is separated by conventional techniques in separation unit 15 to provide liquid products 15L, $C_3$–$C_4$ petroleum gases 15P and a cracked light gas stream 15G, consisting mainly of methane, ethene and ethane, with varying amounts of hydrogen, acetylene and $C_3$+components. The cracked light gas is brought to process pressure by compressor means 16 and cooled below ambient temperature by heat exchange means 17, 18 with liquid being separated in drum 25 and fed to the demethanizer 30 by line 25L. The vapor becomes a feedstock for the cyrogenic separation, as herein described.

The vapor stream 25V is directed through heat exchange means 19, where it is cooled and partially condensed, to drum 20. The vapor is withdrawn from drum 20 in stream 20V and is further cooled and partially condensed in exchanger 21. The resulting effluent 22 is further separated in drum 24. The vapor from drum 24 is withdrawn as methane and hydrogen rich stream 24V.

The liquids from drums 25, 20 and 24 are fed to demethanizer 30 by lines 25L, 20L and 24L, respectively. An ultra-low cryogenic temperature is employed in heat exchanger 31 to refrigerate overhead from demethanizer fractionation zone 30 to recover methane from the liquid condensate streams 25L, 20L and 24L in a demethanizer overhead vapor stream 32 and to recover a liquid demethanizer bottoms stream 30L rich in ethane, ethene and heavier material and substantially free of methane. The demethanizer overhead vapor stream is cooled with ultra-low temperature refrigerant, such as is available from an ethylene refrigerant loop, to provide liquid reflux 30R for recycle to a top portion of demethanizer zone 30.

The desired purity of an ethene product is then achieved by further fractionating the $C_2$+liquid bottoms stream 30L from demethanizer zone 30 in a de-ethanizer fractionation tower 40 to remove $C_3$ and heavier hydrocarbons in a $C_3$+stream 40L and provide a crude ethene stream 40V.

Pure ethene is recovered from a $C_2$ product splitter tower 50 via overhead 50V by fractionating the crude ethene stream 40V to obtain a purified ethene product. The ethane bottoms stream 50L can be recycled to cracking unit 10 along with $C_2$+stream 40L, with recovery of thermal values by indirect heat exchange with moderately chilled feedstock in exchangers 17, 18 and/or 19R.

Optionally a portion or all of the methane-rich overhead 24V is sent through line 24F to a hydrogen recovery unit, not shown, utilized as fuel gas, etc. In some separation systems a front end de-ethanizer unit is employed in the pre-separation operation 15 to remove heavier components prior to entering the cryogenic chilling train. In such configuration, an optional liquid stream 25A from the primary chiller provides a liquid rich in ethane and ethene for recycle to the top of the front end de-ethanizer tower as reflux. This technique permits elimination of a downstream de-ethanizer, such as unit 40, so that primary demethanizer bottoms stream 30L can be sent to product splitter 50.

Another optional feature of the process configuration is the acetylene hydrogenation unit 60, connected to receive at least one ethene-rich stream containing unrecovered acetylene, which may be reacted catalytically with hydrogen prior to final ethene product fractionation.

Figure 2:
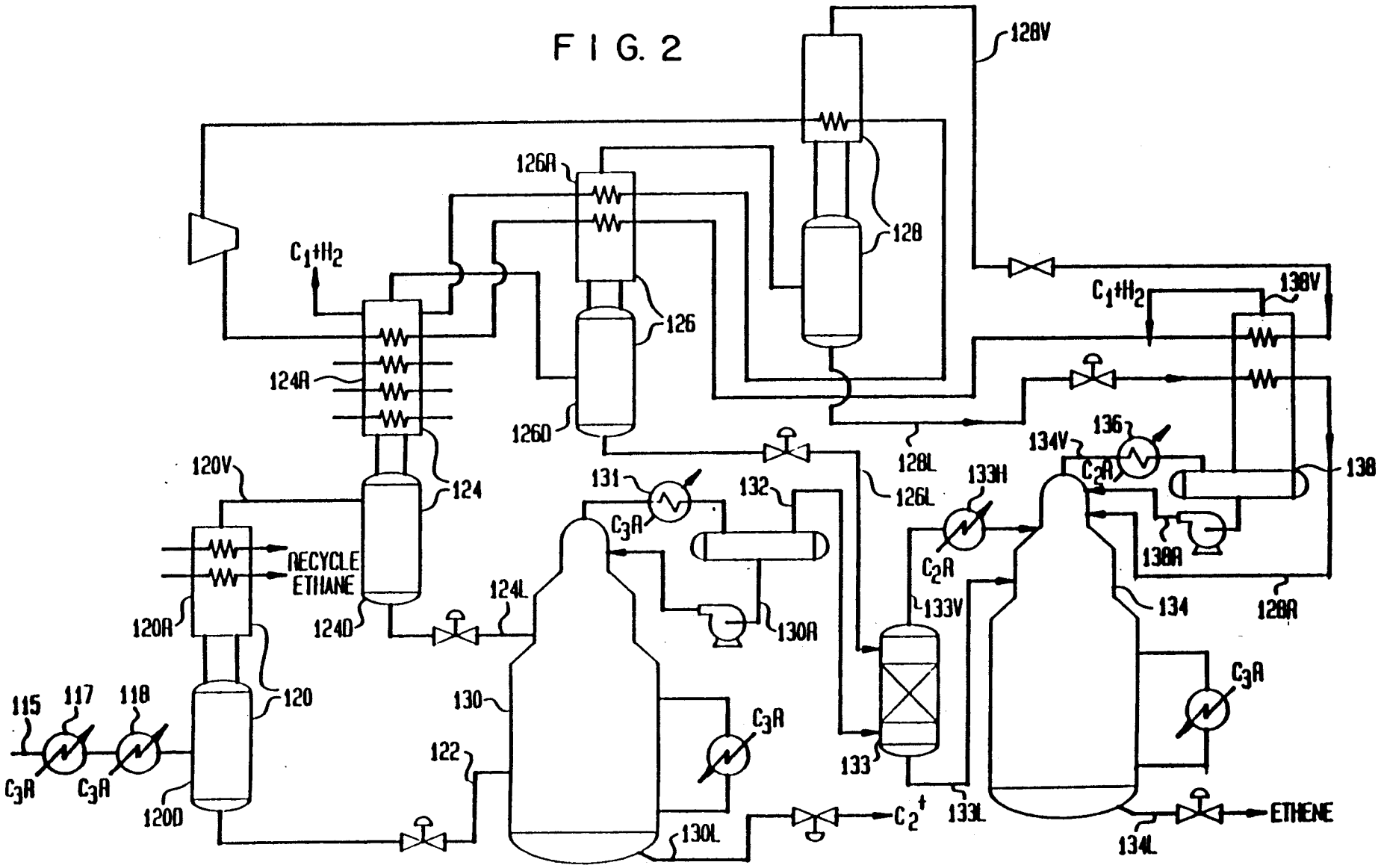
FIG. 2 is a detailed process and equipment diagram showing a plural chilling train and dual high pressure demethanizer fractionation system utilizing dephlegmators.

An improved chilling train using plural dephlegmators in sequential arrangement in combination with a multi-zone demethanizer fractionation system is shown in FIG. 2. In this embodiment several sources of low temperature refrigerants are employed. Since suitable refrigerant fluids are readily available in a typical refinery, the preferred moderately low temperature external refrigeration loop is a closed cycle propylene system ($C_3R$), which has a chilling temperature down to about 235° K. (−37° F.). It is economic to use $C_3R$ loop refrigerant due to the relative power requirements for compression, condensation and evaporation of this refrigerant and also in view of the materials of construction which can be employed in the equipment. Ordinary carbon steel can be used in constructing the primary demethanizer column and related reflux equipment, which is the larger unit operation in a dual demethanizer subsystem according to this invention. The $C_3R$ refrigerant is a convenient source of energy for reboiling bottoms in the primary and secondary demethanizer zones, with relatively colder propylene being recovered from the secondary reboiler unit. By contrast, the preferred ultra low temperature external refrigeration loop is a closed cycle ethylene system ($C_2R$), which has a chilling temperature down to about 172° K. (−150° F.), requiring a very low temperature condenser unit and expensive Cr-Ni steel alloys for safe construction materials at such ultra low temperature. By segregating the temperature and material requirements for ultra low temperature secondary demethanization, the more expensive unit operation is kept smaller in scale, thereby achieving significant economy in the overall cost of cryogenic separation. The initial stages of the dephlegmator chilling train can use conventional closed refrigerant systems, cold ethylene product, or cold ethane separated from the ethene product is advantageously passed in heat exchange with feedstock gas in the primary rectification unit to recover heat therefrom.

Referring to FIG. 2, dry compressed feedstock is passed at process pressure (3700 kPa) through a series of heat exchangers 117, 118 and introduced to the chilling train. The serially connected rectification units 120, 124, 126, 128, each have a respective lower drum portion 120D, 124D and upper rectifying heat exchange portion 120R, 124R, etc. The preferred chilling train includes at least two intermediate rectification units for partially condensing first and second progressively colder intermediate liquid streams respectively from primary rectification overhead vapor stream 120V prior to a final serial rectification unit 128. It is advantageous to fractionate the first intermediate liquid stream 124L in the primary demethanizer zone 130, and then fractionate a second intermediate liquid stream 126L in the second demethanizer zone 134. An intermediate liquid gas contact tower 133, such as a packed column, provides for heat exchange and mass transfer operations between intermediate liquid stream 126L and primary demethanizer overhead vapor 132 in countercurrent manner to provide an ethene-enriched liquid stream 133L passed to a middle stage of secondary demethanizer tower 134, where it is further depleted of methane. The methane-enriched vapor stream 133V is passed through ultra low temperature exchanger 133H for prechilling before being fractionated in the higher stages of tower 134. Optionally, the heat exchange function provided by unit 133 may be provided by indirectly exchanging the gas and liquid streams. The colder input to the secondary demethanizer reduces its condenser duty.

In addition to ultra low temperature condensation of vapor 134V in exchanger 136 to provide secondary demethanizer reflux stream 138R, a dephlegmator unit 138 condenses any residual ethene to provide a final demethanizer overhead 138V which is combined with methane and hydrogen from stream 128V and passed in heat exchange relationship with chilling train streams in the intermediate dephlegmators 126R, 124R. Ethene is recovered from the final chilling train condensate 128L by passing it to an upper stage of secondary demethanizer 134 after passing it as a supplemental refrigerant in the rectifying portion of unit 138. A relatively pure $C_2$ liquid stream 134L is recovered from the fractionation system, typically consisting essentially of ethene and ethane in mole ratio of about 3:1 to 8:1, preferably at least 7 moles of ethene per mole of ethane. Due to its high ethene content, this stream can be purified more economically in a smaller $C_2$ product splitter column. Being essentially free of any propane or other higher boiling component, ethene-rich stream 134L can bypass the conventional de-ethanizer step and be sent directly to the final product fractionator tower. By maintaining two separate feedstreams to the ethene product tower, its size and utility requirements are reduced significantly as compared to conventional single feed fractionators. Such conventional product fractionators are typically the largest consumer of refrigeration energy in a modern olefins recovery plant.

Numerous modifications to the system may be made within the scope of the inventive concept. For instance, unitized construction can be employed to house the entire demethanizer chilling train function in a single multizone distillation tower. This technique is adaptable for retrofitting existing cryogenic plants or new grass roots installations. Skid mounted units are desirable for some plant sites.

A material balance for the process of FIG. 2 is given in the following table. All units are based on steady state continuous stream conditions and the relative amounts of the components in each stream are based on 100 kilogram moles of ethene in the primary feedstock. The energy requirements of major unit operations are also given by providing stream enthalpy.

Material Balance

| Stream No. | 115 | 130 R | 122 | 120 V | 124 L | 126 L | 128 V | 128 R |
|---|---|---|---|---|---|---|---|---|
| Temp° C. | 16.1 | −34.4 | −18.3 | −34.4 | −39.7 | −77.6 | −126.1 | 99.4 |
| Pressure (kgf/cm$^2$) | 37.1 | 31.9 | 36.8 | 36.6 | 36.7 | 36.49 | 36.1 | 29.7 |
| Ethalpy (kCal, MM) | 3.1447 | 0.4455 | 0.2721 | 2.1873 | 0.3699 | 0.9027 | 0.9259 | 0.3529 |
| Vapor mol. fract. | 1.0 | 0 | 0 | 1.0 | 0 | 0 | 1.0 | 0 |
| Flowrates (kG-mol) | | | | | | | | |
| Total | 299.15 | 9.16 | 65.69 | 233.45 | 86.35 | 24.14 | 115.24 | 7.72 |
| Hydrogen ($H_2$) | 79.02 | .23 | .67 | 78.34 | 1.11 | .31 | 76.80 | .12 |
| Methane ($CH_4$) | 62.85 | 1.48 | 4.64 | 58.20 | 9.28 | 6.12 | 37.81 | 4.98 |
| Acetylene ($C_2H_2$) | 1.3 | .69 | .48 | .81 | .74 | .69 | 0 | .11 |
| Ethylene ($C_2H_4$) | 100.0 | 5.94 | 27.36 | 72.63 | 53.89 | 16.09 | .83 | 2.57 |
| Ethane ($C_2H_6$) | 32.4 | 1.64 | 12.63 | 19.79 | 18.20 | 1.54 | .11 | .48 |
| Propyne ($C_3H_4$) | .45 | 0 | .43 | .22 | .22 | 0 | 0 | 0 |
| Propylene ($C_3H_6$) | 12.8 | .58 | 10.53 | 2.30 | 2.29 | .11 | .11 | 0 |
| Propane ($C_3H_8$) | 5.8 | 0 | 5.02 | .77 | .77 | 0 | 0 | 0 |
| 1,3-Butadiene ($C_4H_6$) | 2.0 | 0 | 1.98 | .16 | .16 | 0 | 0 | 0 |
| 1-Butene ($C_4H_8$) | .66 | 0 | .65 | .58 | .46 | 0 | .11 | 0 |
| 1-Butane ($C_4H_{10}$) | .11 | 0 | .11 | .12 | .11 | 0 | 0 | 0 |
| 1-Pentene ($C_5H_{10}$) | .58 | 0 | .58 | 0 | 0 | 0 | 0 | 0 |
| Benzene ($C_6H_6$) | .52 | 0 | .51 | .12 | 0 | 0 | .11 | 0 |
| Toluene ($C_7H_8$) | .45 | 0 | .45 | 0 | 0 | 0 | 0 | 0 |
| 1-Hexene ($C_6H_{12}$) | .14 | 0 | .14 | 0 | 0 | 0 | 0 | 0 |
| $CO_2$ | .54 | 0 | 0 | .53 | 0 | 0 | .53 | 0 |

| Stream No. | 132 | 133 L | 138 V | 133 V | 134 L | 134 V | 138 R | 130 L |
|---|---|---|---|---|---|---|---|---|
| Temp° C. | −34.4 | −36.2 | −99.6 | −47.4 | −9.9 | −95.3 | −97.8 | 6.4 |
| Pressure (kgf/cm$^2$) | 31.9 | 31.8 | 31.1 | 31.8 | 31.6 | 31.1 | 31.1 | 32.5 |
| Ethalpy (kCal, MM) | 0.3132 | 0.1482 | 0.2253 | 0.2549 | 0.2169 | 0.5295 | 0.2148 | .6486 |
| Vapor mol. fract. | 1.0 | 0 | 1.0 | 1.0 | 0 | 1.0 | 0 | 0 |
| Flowrates (kG-mol) | | | | | | | | |
| Total | 33.66 | 30.1 | 27.16 | 27.69 | 38.36 | 63.49 | 36.3 | 118.38 |
| Hydrogen ($H_2$) | 1.79 | .79 | 2.22 | 2.02 | 0 | 2.40 | .18 | 0 |
| Methane ($CH_4$) | 13.85 | 5.05 | 24.92 | 14.92 | .37 | 60.38 | 35.46 | .69 |
| Acetylene ($C_2H_2$) | .13 | .17 | 0 | .30 | .20 | 0 | 0 | 1.10 |
| Ethylene ($C_2H_4$) | 15.05 | 21.05 | .18 | 10.08 | 33.69 | .70 | .68 | 66.20 |
| Ethane ($C_2H_6$) | 2.83 | 3.75 | 0 | .62 | 4.42 | .47 | .47 | 28.00 |
| Propyne ($C_3H_4$) | 0 | 0 | 0 | 0 | 0 | 0 | 0 | .45 |
| Propylene ($C_3H_6$) | .35 | .47 | 0 | 0 | .47 | 0 | 0 | 12.83 |
| Propane ($C_3H_8$) | 0 | 0 | 0 | 0 | 0 | 0 | 0 | 5.80 |
| 1,3-Butadiene ($C_4H_6$) | 0 | 0 | 0 | 0 | 0 | 0 | 0 | 2.00 |
| 1-Butene ($C_4H_8$) | 0 | 0 | 0 | 0 | 0 | 0 | 0 | .65 |
| 1-Butane ($C_4H_{10}$) | 0 | 0 | 0 | 0 | 0 | 0 | 0 | .11 |

-continued

| Material Balance | | | | | | | | |
|---|---|---|---|---|---|---|---|---|
| 1-Pentene ($C_5H_{10}$) | 0 | 0 | 0 | 0 | 0 | 0 | 0 | .58 |
| Benzene ($C_6H_6$) | 0 | 0 | 0 | 0 | 0 | 0 | 0 | .52 |
| Toluene ($C_7H_8$) | 0 | 0 | 0 | 0 | 0 | 0 | 0 | .45 |
| 1-Hexene ($C_6H_{12}$) | 0 | 0 | 0 | 0 | 0 | 0 | 0 | .14 |
| $CO_2$ | | | | | 0 | 0 | 0 | 0 |

Figure 3:
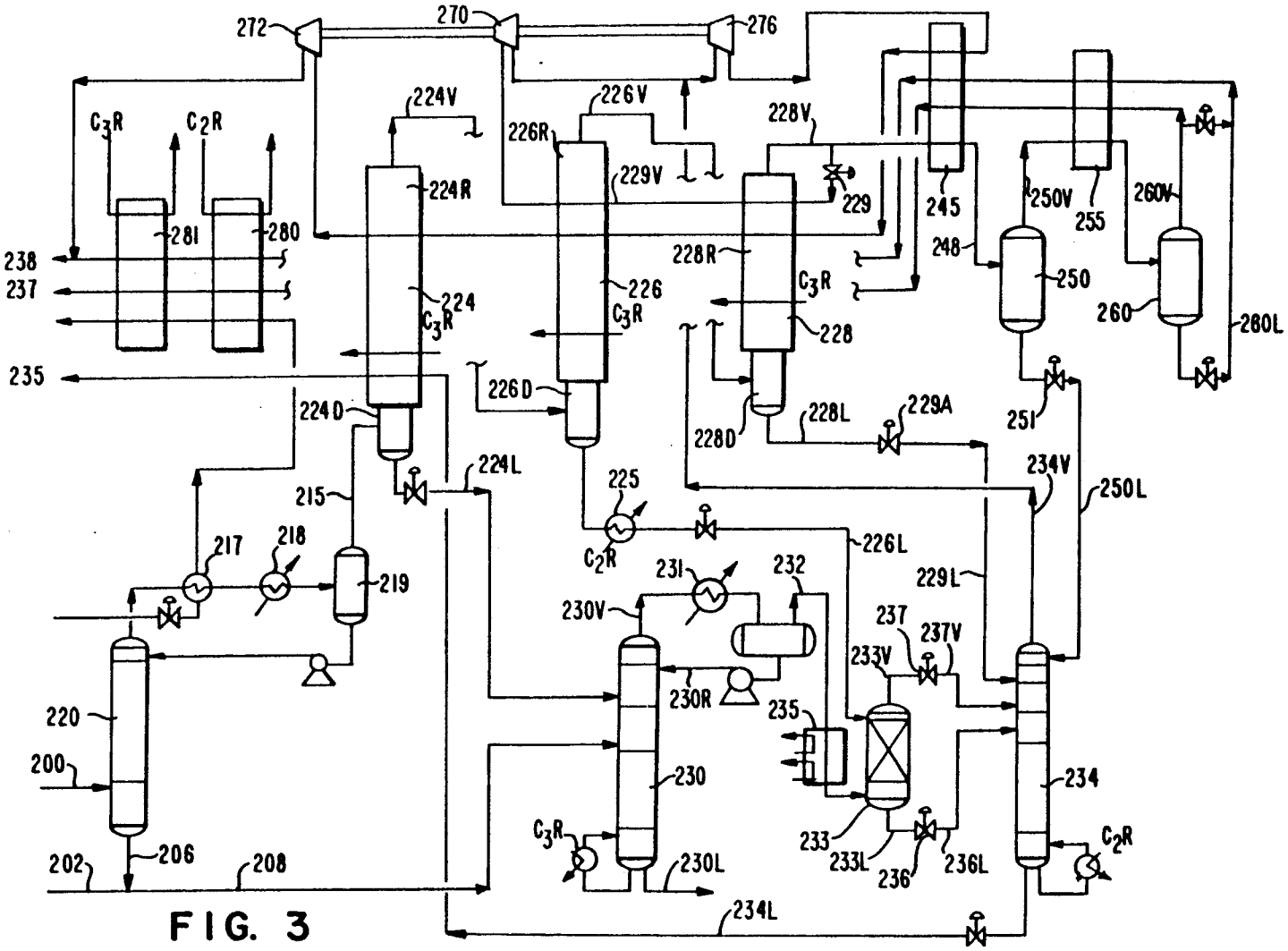
FIG. 3 is a detailed process and equipment diagram showing a plural chilling train utilizing dephlegmation and dual demethanizer fractionation system in which the secondary demethanizer is operated at low pressure.

The system of FIG. 3 is comprised of a cracked gas absorber 220 and three dephlegmators 224, 226 and 228, a primary demethanizer 230, a secondary low pressure demethanizer 234 and valves 229, 237, 236 and 251 to reduce the pressure in the system lines extending to the secondary low pressure demethanizer 234. The valves 229, 237, 231 and 251 are conventional such as well-known throttling valves.

The system of FIG. 3 also includes a hydrogen separation circuit that provides reflux to the secondary low pressure demethanizer 234. Alternatively, expander 276 can provide refrigeration for the secondary low pressure demethanizer 234 and liquid from hydrogen drum 250 can be employed in a heat exchanger (not shown) to cool stream 248. The hydrogen separation circuit is comprised of hydrogen drums 250 and 260 with interconnecting lines. In addition, compressor 272 and expansion turbines 270 and 276 are included in the system and are driven essentially by the excess vapor from the third dephlegmator.

In the separation process of FIG. 3, a dry compressed feedstock, line 200, such as the vapor from a depropanizer, not shown, (at 5° F., 510 psia) is fed to a first rectification unit or cracked gas absorber 220. The vapor effluent passes through line 205 (−10° F., 502 psia) from the cracked gas absorber 220 through a series of heat exchangers 217, 218 and a condenser to a drum 219 to yield vapor stream 215 at −35° F., 500 psia. The liquid from the first rectification unit 220 is fed to the fractionating system. Stream 215 is then introduced to the chilling train. The serially connected rectification units (dephlegmators) 224, 226 and 228 are the same as dephlegmators 124, 126 and 128 and each have a respective lower drum portion 224D, 226D and 228D, and upper rectifying heat exchange portion 224R, 226R and 228R.

In the chilling train, cold pressurized gaseous streams are cooled and partially condensed in serially arranged rectification units (dephlegmators), each of said rectification units being operatively connected to accumulate condensed liquid in a lower liquid accumulator portion by gravity flow from an upper vertical rectifier portion through which gas from the lower accumulator portion passes in an upward direction for direct gas-liquid contact exchange within said rectifier portion, whereby methane-rich gas flowing upwardly is partially condensed in said rectifier portion with cold refluxed liquid in direct contact with the upwardly flowing gas stream to provide a condensed stream of cold liquid flowing downwardly and thereby enriching the condensed liquid gradually with ethene and ethane components.

The liquid stream, line 224L (−44° F, 499 psia), issuing from the bottom of the second rectification unit 224 is purified to remove any residual methane by directing stream 224L to the fractionation system. Stream 224L is first fractionated in the moderately low temperature demethanizer zone 230 which operates at a pressure in the range of about 485 psia. It is also contemplated to direct a liquid effluent stream 202 from a depropanizer (not shown), combined with a liquid stream 206 from the first rectification section, cracked gas absorber 220, as feed line 208 to a lower portion of the moderately low temperature demethanizer zone 230.

The bottoms from the moderately low temperature demethanizer zone 230, represented by line 230L (62° F., 485 psia), is rich in ethane and may optionally be directed to a deethanizer (not shown) for purification.

The vapor issuing from the second rectification unit 224, shown as line 224 V (−85° F., 495 psia), is directed to a lower portion of the third rectification unit 226 for further fractionation. The bottoms liquid stream 226L (−90° F., 494 psia) from the third rectification unit 226 is then directed through a heat exchanger 225 to an upper portion of a liquid gas contact tower 233, such as a packed column, where it (now −115° F., 489 psia, although the contact tower may be operated at low pressure) is contacted in a countercurrent manner with 232 (−26° F., 483 psia) which is optionally precooled to −85° F. in heat exchanger 235. The ethene-enriched liquid stream 233L (−95° F., 475 psia) issuing from the bottom of the contact tower 233 is passed through a valve 236 to form stream 236L (−125° F., 155 psia) and directed to a middle stage of the final ultra low temperature low pressure demethanizer 234, and the vapor stream 233V (−120° F., 473 psia) is passed through valve 237 to form a stream 237 V (−140° F., 152 psia) which is directed to an upper middle stage of the demethanizer 234.

The vapor stream 226 V (−115° F., 490 psia) issuing from the third rectification unit 226 passes for further rectification to a bottom portion of the final rectification unit 228. The bottoms liquid stream 228L (−163° F., 487 psia) is passed through a valve 229A to form a stream 229L (−175° F., 150 psia) which is then directed to an upper portion of the final low pressure demethanizer zone 234. The final low pressure demethanizer zone 234 strips residual methane and hydrogen from the ethene rich feed streams 236L, 237V, 229L and 250L. The bottoms stream 234L (−58° F., 155 psia) is withdrawn, optionally passed in indirect heat exchange relation with the second rectification unit 224, to provide an ethene rich product stream 235 (−45° F., 120 psia).

Since fractionation in the final demethanizer 234 is performed at low pressure, preferably less than about 175 psia, more preferably less than about 160 psia, less external refrigerant and substantially fewer fractionating trays are required than where a high pressure final demethanizer is employed, as shown in FIG. 2 as unit 134. Capital savings also arise from eliminating the overhead condenser circuit, represented as dephlegmator unit 138 in FIG. 2.

The vapor stream 228V (−194° F., 147 psia) from the final rectification unit 228, rich in methane and hydrogen is partially condensed in a heat exchanger 245 and separated in the hydrogen drum 250. Liquid stream 250L is passed through valve 251 (−226° F., 150 psia) and is then directed to the upper portion of the secondary low pressure demethanizer 234 as reflux and for removal of any residual ethene. The vapor stream 250V (−259° F., 475 psia) is further cooled in heat exchanger 255 and separated in hydrogen drum 260 into a vapor stream 260V that is passed through the heat exchanger 255 to exit (−233° F., 470 psia) rich in hydrogen and withdrawn as hydrogen product stream 237 after optional passage through heat exchangers 280 and 281. The liquid stream 260L (−260° F., 78 psia) emanating from the drum 260 is rich in methane and is passed through the heat exchangers 280 and 281 for recovery as fuel gas.

Optionally, a portion of the vapor stream 228V directed by valve means 229 and line 229V (−100° F., 475 psia) and the vapor stream 234V (−192° F., 147 psia) from the final demethanizer 234 are expanded in a two stage turboexpander 270 and 276, stream 229V going through both stages and stream 234 going through only the second stage 276. The combined stream 278 discharges from the second stage expander 276 at −242° F., 47 psia, and is passed through the heat exchanger 245 and then recompressed in compressor 272 and combines with the methane rich stream 260L to form fuel gas product stream 238.

I claim:

1. A cryogenic separation process for recovering $C_2$ hydrocarbons from a hydrocarbon feedstream comprising methane, ethene and ethane, said process comprising:

(a) introducing said hydrocarbon feedstream into a dephlegmation zone at cryogenic temperatures;

(b) dephlegmating said hydrocarbon feedstream into a primary methane-rich gas stream and a primary liquid condensate stream rich in $C_2$+hydrocarbon components and containing a minor amount of methane;

(c) passing said primary liquid condensate stream to a moderately low cryogenic temperature primary demethanizer unit and separating said primary liquid condensate stream into a $C_2$+liquid bottoms stream and intermediate methane-rich overhead vapor stream; and (d) further separating said intermediate methane-rich overhead vapor stream from the moderately low cryogenic temperature primary demethanizer unit in an ultra-low temperature final demethanizer unit operating below about 175 psia to recover a first liquid ethene-rich hydrocarbon product stream and a final demethanizer ultra-low temperature vapor stream; whereby total energy requirements for refrigeration to separate the $C_2$+hydrocarbon from the $C_1$ and lighter components are low.

2. A cryogenic separation process as defined in claim 1 wherein said ultra-low temperature demethanizer unit operates at below about 160 psia.

3. A cryogenic separation process as defined in claim 2 wherein said hydrocarbon feedstream is dried.

4. A cryogenic separation process as defined in claim 3 wherein said hydrocarbon feedstream comprises a gaseous hydrocarbon cracking effluent comprising from about 10 to about 50 mole percent ethene, from about 5 to about 20 mole percent ethane, from about 10 to about 40 mole percent methane and up to about 10 mole percent $C_3$ hydrocarbons.

5. A cryogenic separation process as defined in claim 3 wherein said hydrocarbon feedstream is compressed to a process pressure of from about 2500 kPa to about 3700 kPa prior to step (a).

6. A cryogenic separation process as defined in claim 3 wherein said hydrocarbon feed is prechilled in at least one heat exchanger prior to step (a).

7. A cryogenic separation process as defined in claim 1 wherein said dephlegmation zone comprises at least two serially connected dephlegmators.

8. A cryogenic separation process as defined in claim 7 including the step of:

(b)(i) further dephlegmating said primary methane-rich gas stream from step (b) in a second dephlegmator to produce a secondary liquid condensate stream and a secondary methane-rich gas stream.

9. A cryogenic separation process as defined in claim 8 wherein step (d) also comprises effecting a further separation of the secondary liquid condensate stream from step (b)(i) in said ultra-low temperature final demethanizer unit.

10. A cryogenic separation process as defined in claim 8 wherein step (d) comprises (d)(i) contacting said intermediate methane-rich overhead vapor stream from the moderately low cryogenic temperature primary demethanizer unit and said secondary liquid condensate stream from the second dephlegmator in a countercurrent liquid-gas contact zone; and (d)(ii) feeding the resulting methane-depleted liquid stream from said countercurrent liquid-gas contact zone to a lower portion of the ultra-low temperature final demethanizer and feeding the resulting methane-enriched vapor from said countercurrent liquidgas contact zone to an upper portion of said ultra-low temperature final demethanizer; wherein said ultra-low temperature final demethanizer unit is operated at a pressure below about 160 psia; to recover a liquid ethene-rich hydrocarbon product stream and a final demethanizer ultra-low temperature vapor stream.

11. A cryogenic separation process as defined in claim 10 wherein said countercurrent liquid-gas contact zone comprises a packed column.

12. A cryogenic separation process as defined in claim 1 wherein said dephlegmation zone comprises two or more serially connected dephlegmators.

13. A cryogenic separation process as defined in claim 12 including the steps of (b)(i) further dephlegmating said primary methane-rich gas stream from step (b) in a second dephlegmator to produce a secondary liquid condensate stream and a secondary methane-rich gas stream; and (b)(ii) further dephlegmating said secondary methane-rich gas stream from step (b)(i) in a third dephlegmator to produce a third liquid condensate stream and a third methane-rich gas stream.

14. A cryogenic separation process as defined in claim 13 wherein step (d) also comprises effecting a further separation of secondary liquid condensate stream from the second dephlegmator and the third liquid condensate stream from the third dephlegmator in said ultra-low temperature final demethanizer unit.

15. A cryogenic separation process as defined in claim 14 wherein step (d) comprises:

(d)(i) contacting said intermediate methane-rich overhead vapor stream from the moderately low cryogenic temperature primary demethanizer unit and said secondary liquid condensate stream from the second dephlegmator in a countercurrent liquid-gas contact zone;

(d)(ii) feeding the resulting methane-depleted liquid stream from said countercurrent liquid-gas contact zone to a lower portion of the ultra low temperature final demethanizer and feeding the resulting methane-enriched vapor stream from said countercurrent liquid-gas contact zone to an upper portion of said ultra-low temperature final demethanizer; and (d)(iii) feeding the third liquid condensate stream to said ultra-low temperature final demethanizer at a point above the feedpoint of said resulting methane-enriched vapor stream.

16. A cryogenic separation process as defined in claim 15 wherein said countercurrent liquid gas contact zone comprises a packed column.

17. A cryogenic separation process as defined in claim 13 comprising the further step of separating the third methane-rich gas stream into a fourth overhead vapor stream and a fourth liquid bottoms stream and delivering the fourth liquid bottoms stream to the ultra low temperature final demethanizer.

18. A cryogenic separation process as defined in claim 17 comprising the further step of expanding a portion of the third methane rich gas from the third dephlegmator in an expansion turbine.

19. A cryogenic separation process as defined in claim 18 comprising the further step of expanding the final demethanizer ultra-low temperature vapor stream in an expansion turbine.

20. A cryogenic separation process as defined in claim 19 wherein the temperature and pressure at the first dephlegmator is about −35° F. and 500 psia; the temperature and pressure at the second dephlegmator is about −85° F. and 495 psia; the temperature and pressure at the third dephlegmator is about −145° F. and 480 psia; the temperature and pressure in the moderately low cryogenic temperature primary demethanizer is about −44° F. and 500 psia; the temperature and pressure in the ultra low cryogenic temperature final demethanizer is about −150° F. and 150 psia; the temperature and pressure in the countercurrent liquid-gas contact zone is about −85° F. and 475 psia; the temperature and pressure in the separation drum downstream of the third dephlegmator is about −225° F. and 480 psia; the temperature and pressure in the final gas separation drum is about −60° F. and 475 psia; the temperature and pressure of the third methane rich gas from the third dephlegmator entering the expansion turbine is about −100° F. and 475 psia; and the temperature and pressure in the methane product line is about 50° F. and 70 psia.

21. A cryogenic separation process as defined in claim 1 comprising the additional steps of (e) further fractionating the $C_2$+bottoms stream from said moderately low cryogenic temperature primary demethanizer unit to remove ethane and heavier hydrocarbons and to provide a second ethene-rich product stream; and (f) fractionating said second ethene-rich product stream and the first ethene-rich product stream from said ultra-low temperature final demethanizer unit to obtain a substantially pure ethene product.

22. A cryogenic separation process as defined in claim 1 wherein the primary cryogenic temperature ranges from about 236° to about 270° K., the moderately low cryogenic temperature ranges from about 197° to about 235° K. and the ultra-low cryogenic temperature ranges from about 172° to about 196° K.

23. A cryogenic separation process as defined in claim 22 wherein a closed cycle propylene refrigeration loop system is employed as a moderately low temperature refrigerant and a closed cycle ethylene refrigeration loop system is employed as an ultra-low temperature refrigerant.

24. An apparatus for performing cryogenic separation of a hydrocarbon feedstream comprised of methane, ethane, ethylene which comprises:

(a) means for dephlegmating the hydrocarbon feedstream;

(b) means for demethanizing liquid from the means for dephlegmating the hydrocarbon feedstream comprising (i) a moderately low cryogenic temperature primary demethanizer unit serially connected to (ii) an ultra-low temperature final demethanizer unit operated at below about 160 psia; and (c) means for delivering a primary liquid condensate stream from said means for dephlegmating to said means for demethanizing.

25. An apparatus as defined in claim 24 wherein said means for dephlegmating the hydrocarbon feedstream comprises at least two serially connected dephlegmators.

26. An apparatus as defined in claim 25 further comprising a means for delivering a second liquid condensate stream from the second dephlegmator to said ultra-low temperature final demethanizer unit.

27. An apparatus as defined in claim 25 further comprising a means for countercurrently contacting a second liquid condensate stream from the second dephlegmator and an overhead vapor stream from said moderately low cryogenic temperature primary demethanizer and a means for operatively connecting said countercurrent contacting means to said ultra-low temperature final demethanizer unit.

28. An apparatus as defined in claim 27 wherein said means for dephlegmating the hydrocarbon feedstream comprises three serially connected dephlegmators.

29. An apparatus as defined in claim 28 further comprising a means for delivering a third liquid condensate stream from the third dephlegmator to an upper portion of said ultra-low temperature final demethanizer unit.

30. An apparatus as defined in claim 29 further comprising a hydrogen-methane separating means operatively connected to a third overhead vapor stream from said third dephlegmator.

31. An apparatus as defined in claim 30 further comprising a means for delivering a liquid stream from said hydrogen-methane separating means to said ultra-low temperature final demethanizer unit.

32. An apparatus as defined in claim 31 further comprising a means for expanding a portion of the third overhead vapor stream.

33. An apparatus as defined in claim 32 further comprising a means for expanding a final demethanizer ultra-low temperature vapor stream from the said ultra-low temperature final demethanizer unit.

34. An apparatus as defined in claim 27 wherein said means for operatively connecting said countercurrent contacting means to said ultra-low temperature final demethanizer unit further comprises a means for reducing pressure.

35. An apparatus as defined in claim 29 wherein said means for delivering a third liquid condensate stream from the third dephlegmator to an upper portion of said ultra-low temperature final demethanizer unit further comprises a means for reducing pressure.

36. An apparatus as defined in claim 31 wherein said means for delivering a liquid stream from said hydrogen-methane separating means to said ultra-low temperature final demethanizer unit further comprises a means for reducing pressure.

37. A cryogenic separation method for recovering $C_2$+hydrocarbons from cracked hydrocarbon feed gas comprising methane, ethene and ethane, wherein cold pressurized gaseous streams are separated in a plurality of dephlegmator units, each of said dephlegmator units being operatively connected to accumulate condensed liquid in a lower dephlegmator drum vessel by gravity flow from an upper dephlegmator heat exchanger comprising a plurality of vertically disposed indirect heat exchange passages through which gas from the lower drum vessel passes in an upwardly direction for cooling with refrigerant fluid by indirect heat exchange within said heat exchange passages, whereby gas flowing upwardly is partially condensed on vertical surfaces of said passages to form a reflux liquid in direct contact with the upwardly flowing gas stream to provide a condensed stream of cooler liquid flowing downwardly and thereby enriching condensed dephlegmator liquid gradually with $C_2$+hydrocarbon components; comprising the steps of introducing dry feed gas into a primary dephlegmation zone having a plurality of serially connected, sequentially colder dephlegmator units for separation of feed gas into a primary methane-rich gas stream recovered at low temperature and at least one primary liquid condensate stream rich in $C_2$+hydrocarbon components and containing a minor amount of methane;

passing at least one primary liquid condensate stream from the primary dephlegmation zone to serially connected demethanizer fractionators, wherein a moderately low cryogenic temperature is employed in a first demethanizer fractionator unit to recover substantially all of the methane from the primary liquid condensate stream in a first demethanizer overhead vapor stream and to recover a first $C_2$+liquid demethanizer bottoms stream substantially free of methane; and further separating at least a portion of the first demethanizer overhead vapor stream in an ultra-low temperature final demethanizer fractionator unit operating at a pressure below about 160 psia; to recover a liquid ethene-rich predominantly $C_2$ hydrocarbon crude product stream and a final demethanizer ultra-low temperature overhead vapor stream substantially free of $C_2$+hydrocarbons.

38. The process of claim 37 further comprising a countercurrent direct stream contact unit, operatively connected between the primary and secondary demethanizer zones, the liquid from said countercurrent contact zone is directed to a lower stage of the secondary demethanizer zone and the vapor from said countercurrent contact zone is directed to a higher stage of the secondary demethanizer zone.

39. The process of claim 38 wherein said serially connected rectification units include at least one intermediate rectification unit for partially condensing an intermediate liquid stream from primary rectification overhead vapor prior to final serial rectification unit; and contacting at least a portion of said first demethanizer overhead vapor stream with said intermediate liquid stream directly in a countercurrent contact zone operatively connected between the primary and secondary demethanizer zones, with methane-enriched vapor from said countercurrent contact zone being directed to an upper portion of the secondary demethanizer zone.

40. The process of claim 39 wherein said serially connected rectification units include two intermediate rectification units for partially condensing first and second progressively colder intermediate liquid streams respectively from primary rectification overhead vapor prior to a final serial rectification unit;

fractionating the first intermediate liquid stream in the primary demethanzier zone; and fractionating the second intermediate liquid stream in the secondary low pressure demethanizer zone.

41. The process of claim 40 including the step of contacting at least a portion of said first demethanizer overhead vapor stream with said second intermediate liquid stream in a countercurrent contact zone operatively connected between the primary and secondary demethanizer zones, with ethene-rich liquid from said countercurrent contact zone being directed to an upper portion of the secondary low pressure demethanizer zone.

42. The process of claim 41 wherein said moderately low temperature coolant is maintained at a temperature of about 235° K. to 290° K. and the ultra low temperature coolant is maintained below 235° K.

43. The process of claim 42 wherein pressurized moderately low temperature refrigerant is condensed in a refrigerant cycle in heat exchange relationship with a primary demethanizer reboiler unit to heat liquid methanized bottoms therein.

44. The process of claim 43 including a closed loop moderately low temperature source of primary refrigerant consisting essentially of propylene and a separate closed loop ultra low temperature refrigerant source of secondary refrigerant consisting essentially of ethylene.

* * * * *